US005373131A

United States Patent [19]

Perret et al.

[11] Patent Number: 5,373,131

[45] Date of Patent: Dec. 13, 1994

[54] PUFFER CIRCUIT-BREAKER WITH TWO CONCENTRIC INTERRUPTING CHAMBERS

[75] Inventors: Michel Perret, Bourgoin-Jallieu; Denis Dufournet, Bron, both of France

[73] Assignee: GEC Alsthom T & D SA, Paris, France

[21] Appl. No.: 95,004

[22] Filed: Jul. 26, 1993

[30] Foreign Application Priority Data

Jul. 24, 1992 [FR] France ..... 92 09169

[51] Int. Cl.[5] ..... H01H 33/74; H01H 33/88

[52] U.S. Cl. ..... 200/148 A; 200/148 R; 200/148 B

[58] Field of Search ..... 200/148 R, 148 A, 148 B, 200/148 BV

[56] References Cited

U.S. PATENT DOCUMENTS 4,239,949 12/1980 Kii et al. ..... 200/148 R
4,259,555 3/1981 Kii ..... 200/148 R
4,594,488 6/1986 Talpo ..... 200/148 R
4,604,508 8/1986 Talpo ..... 200/148 R
5,179,257 1/1993 Dufournet et al. ..... 200/148 A

FOREIGN PATENT DOCUMENTS 0150079 7/1985 European Pat. Off. .
0415098 3/1991 European Pat. Off. .
2385209 10/1978 France .

*Primary Examiner*—J. R. Scott
*Attorney, Agent, or Firm*—Sughrue, Mion, Zinn, Macpeak & Seas

[57] ABSTRACT

A puffer circuit-breaker comprises a first interrupting chamber (2), a second interrupting chamber (4) situated within the first interrupting chamber, and a stationary electric arcing contact (6) which extends inside the second interrupting chamber. The second interrupting chamber is movably mounted in the first interrupting chamber and is arranged to slide along the stationary contact. This arrangement provides good arc-extinction both at low electric current and at high electric current.

7 Claims, 5 Drawing Sheets

PUFFER CIRCUIT-BREAKER WITH TWO CONCENTRIC INTERRUPTING CHAMBERS

BACKGROUND OF THE INVENTION

The invention relates to a puffer circuit-breaker comprising a casing which is intended to be filled with an electric arc extinguishing fluid, a first closure member disposed inside the casing and defining a first thermal expansion chamber, a second closure member disposed within the first closure element and defining a second thermal expansion chamber, a first contact slidably mounted within the casing to slide axially so as to extend through said first and second thermal expansion chambers in order to co-operate electrically with a second contact stationary within the casing and extending axially inside the second thermal expansion chamber.

The invention is particularly applicable to high voltage and to medium voltage circuit-breakers which have a casing filled with a gas of good dielectric properties, in particular $SF_6$, and which have neither an extinguishing piston nor a magnet.

U.S. Pat. No. 4,259,555 shows such a puffer circuit-breaker comprising two thermal expansion chambers of different volumes allowing a wide range of electrical currents to be interrupted, for example currents in the range 0 to 25000 amps.

SUMMARY OF THE INVENTION

The object of the invention is to improve the performance of such a thermal expansion gas circuit-breaker with two expansion chambers, so as to interrupt more efficiently the low and the high currents within a wide range of electrical currents.

The object of the invention is therefore to provide a puffer circuit-breaker, characterized in that the second closure member is mounted for translational movement in the casing so as to move from inside the first thermal expansion chamber to outside said chamber and vice versa, said second closure member also being arranged to slide along the second stationary contact.

Such an arrangement allows improved extinguishing of the electric arc when interrupting low currents.

Moreover, since the second closure member also slides along the arcing contact complementary to the moving arcing contact, improved extinguishing of the electric arc is obtained at high currents.

Advantageously, the second closure member is incorporated within the first closure member so as to reduce the stroke of the moving arcing contact.

The invention gives the following advantages. The interrupting element is simple in construction. The circuit-breaker has fewer parts compared with conventional two-chamber puffer circuit-breakers. A circuit-breaker in accordance with the invention operates with a much lower control power than devices which have two moving contacts per pole. The circuit-breaker operates over the whole range of currents from 0 to 25000 amps, and higher in certain cases.

BRIEF DESCRIPTION OF THE DRAWINGS

Other features and advantages of the invention will be apparent from the description which follows of one embodiment of the invention, made with reference to the accompanying drawings in which.

DETAILED DESCRIPTION OF THE PREFERRED EMBODIMENTS

Figure 1:
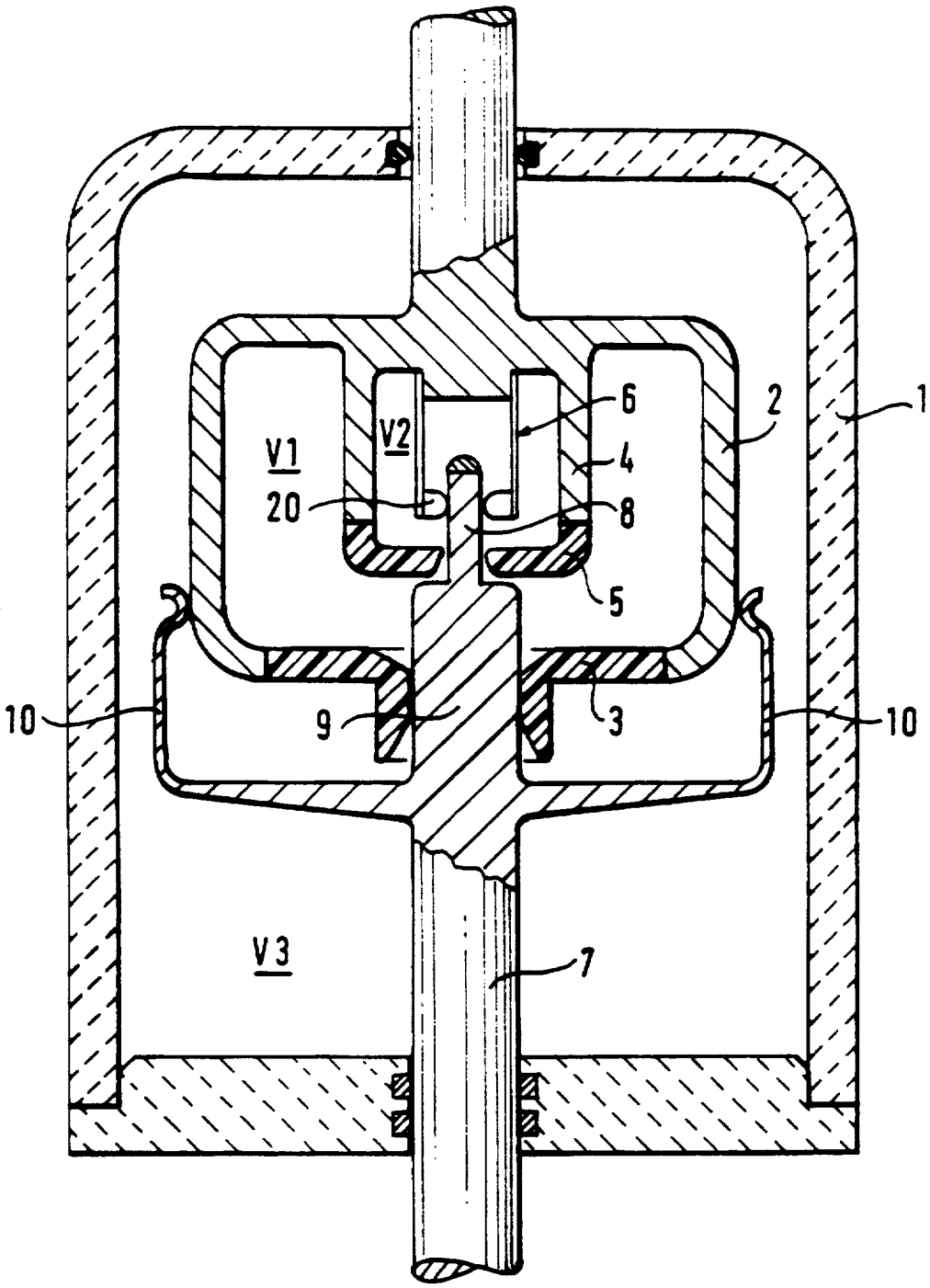
FIG. 1 shows schematically the circuit-breaker according to the invention comprising two stationary concentric expansion chambers.

The circuit-breaker for medium or high voltages shown in FIG. 1 comprises a hermetic casing 1 filled with a dielectric gas such as $SF_6$ and housing an electric arc interrupting assembly.

The interrupting assembly comprises a first cylinder 2 which defines a thermal expansion chamber of volume V1 with a blast nozzle 3 for extinguishing the electric arc produced by high currents to be interrupted, and a second cylinder 4 integral with the cylinder 2 and carrying a nozzle 5 for extinguishing the electric arc produced by low currents to be interrupted. The second cylinder 4 defines a thermal expansion chamber of volume V2, where V2 is smaller than V1. Preferably, the two cylinders are arranged concentrically (coaxial cylinders) to give a compact interrupting assembly.

A first stationary arcing contact 6, which is electrically connected to a first current terminal through the two cylinders 4 and 2, is situated inside the small cylinder 4 in the arcing zone. This first contact may be of the thimble type and has contact fingers 20.

Each cylinder 2, 4 has a closed end connected to the casing and carrying the stationary arcing contact 6, and an open end carrying a blast nozzle 3, 5. The blast nozzles 3, 5 are superposed and separated from each other as shown in FIG. 1, and they are provided with substantially concentric (axially aligned) gas-passing sections. A single rectilinear moving arcing contact 7 passes through the nozzles, this contact being electrically connected to a second current terminal and being mechanically connected to an operating member which causes the contact to slide within the nozzles in a direction perpendicular to their cross-sections so as either to engage between the fingers 20 of the stationary contact 6 or else to disengage from them. The contacts 6 and 7 are in alignment.

The moving arcing contact has an end portion 8 of cross-section complementary to that of the nozzle 5 so as to close the nozzle 5, and a central portion 9 of cross-section complementary to that of the nozzle 3 so as to close the nozzle 3. The gas-passing section of the nozzle 5 is smaller than that of the nozzle 3, the dimensions of these sections being a function of the volumes of the respective expansion chambers.

The moving arcing contact 7 also has permanent current passing fingers 10 for establishing electrical contact with the outside surface of the first cylinder 2.

In FIG. 1, the moving arcing contact 7 is engaged in the stationary contact 6. In the closed position, current passes through the fingers 10 of the permanent or main contact.

Operation of the circuit-breaker is as follows. When a low current is passing through the interrupting assembly and is to be interrupted, then the operating member of the circuit-breaker is actuated so as to displace the moving contact 7. The permanent current passing through the fingers 10 of the main contact is interrupted first of all, followed by switching of the arcing contacts 6 and 7 so that an electric arc appears across them. The energy emitted by the electric arc causes the pressure of the gas in the volume V2 to rise due to increase in temperature, and gas flows from this volume to the volume V1 which acts as an expansion volume due to the difference in pressure between these two volumes and due to the disengagement of the moving contact 7 from the nozzle 5 as the contact is displaced. The flow of gas interrupts the electric arc on current zero.

In the case where a high current is to be interrupted, the energy emitted by the arc causes the gas pressure to rise both in volume V1 and in volume V2, and gas flows from volumes V1 and V2 into the expansion volume V3 to extinguish the electric arc, the arcing contact 7 also being free from the nozzle 3 at the end of its stroke.

Consequently, simply by sliding the contact 7 within the nozzles 3 and 5, electric arcs can be extinguished both, with low and with high currents.

Figure 2:
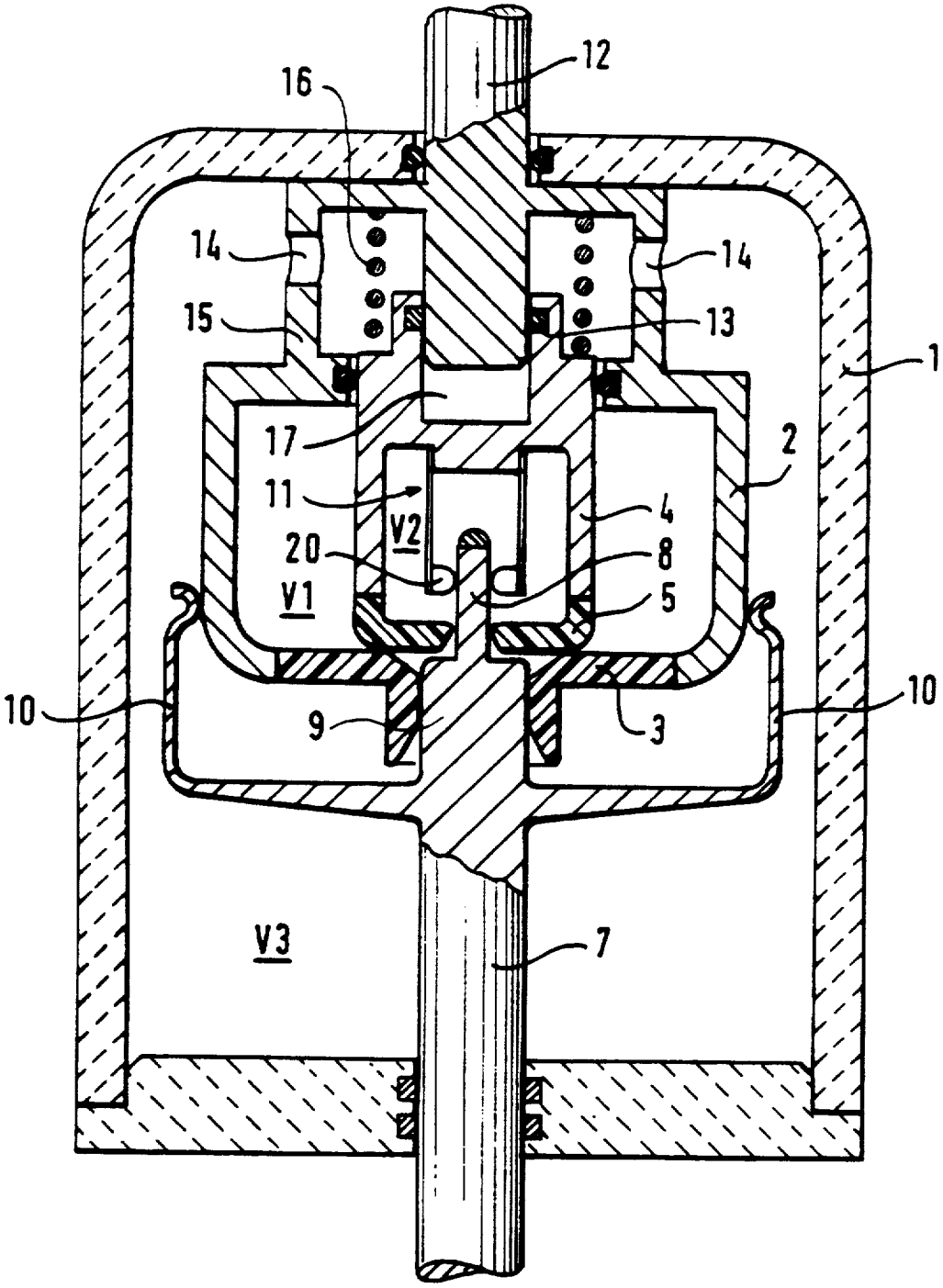
FIG. 2 shows schematically the circuit-breaker according to the invention having two expansion chambers, one of which is movable with respect to the other, the moving arcing contact being in the engaged position.

In a variant, as shown in FIG. 2, the small cylinder 4 is slidably mounted inside the large cylinder 2 and carries a portion 11 of the first contact 6, the other portion 12 of the contact 6 which is connected to the first electrical terminal being stationary. This portion 12 lies within a cavity 17 formed in the small cylinder 4 and is electrically connected to the small cylinder 4 by corrugated contacts 13. The large cylinder 2 is connected at its closed end to the casing 1 via a third cylinder 15 which has apertures 14 opening into the expansion volume V3, the small cylinder 4 also sliding inside cylinder 15.

When the moving arcing contact 7 is in the engaged position, the nozzle 5 is pressed against the nozzle 3 by the action of a spring 16 which bears against the wall of the casing and exerts a thrust on the small cylinder 4.

Figure 3:
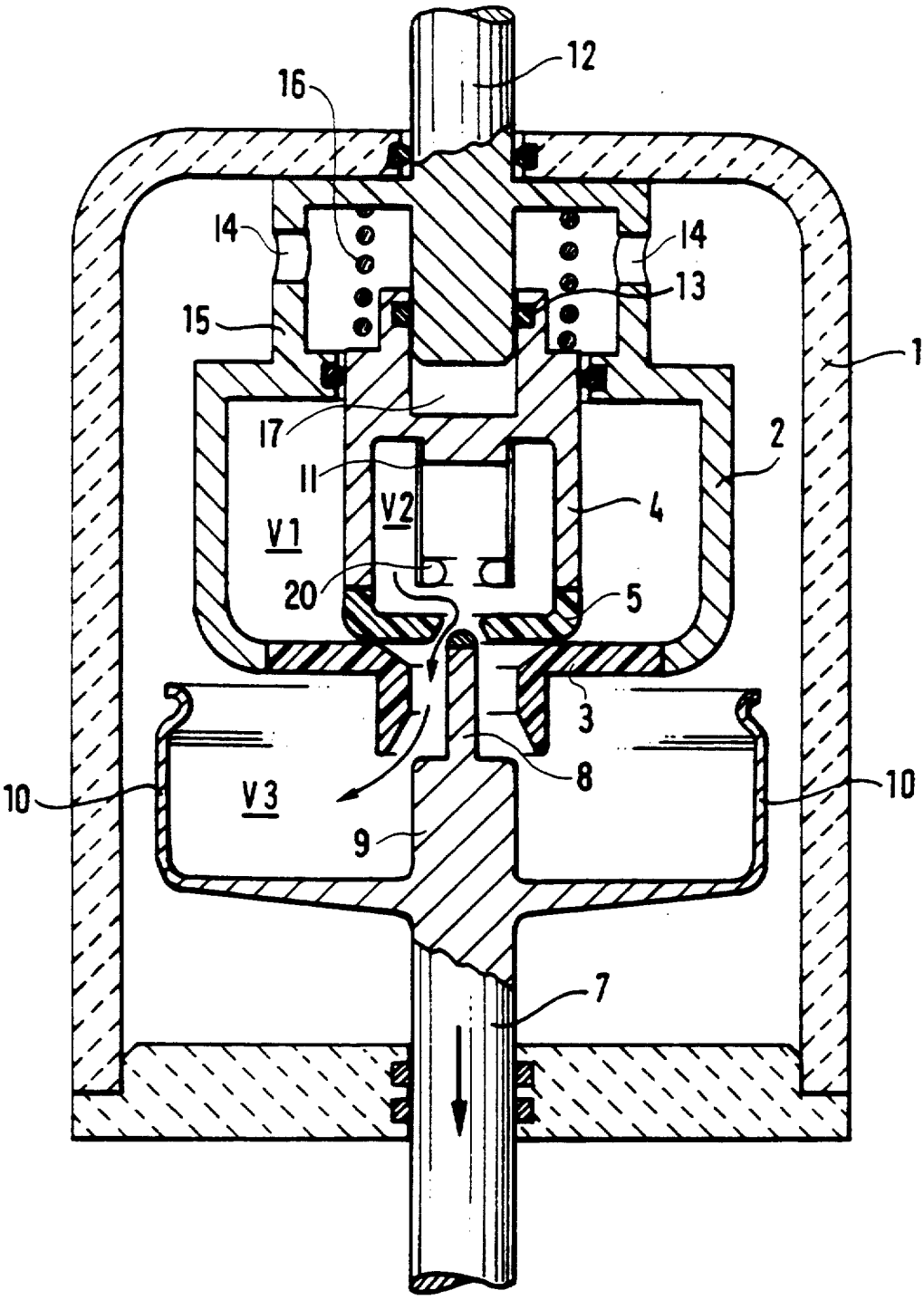
FIG. 3 shows schematically the circuit-breaker of FIG. 2, the moving arcing contact being in the position suitable for interrupting low currents.
Figure 4:
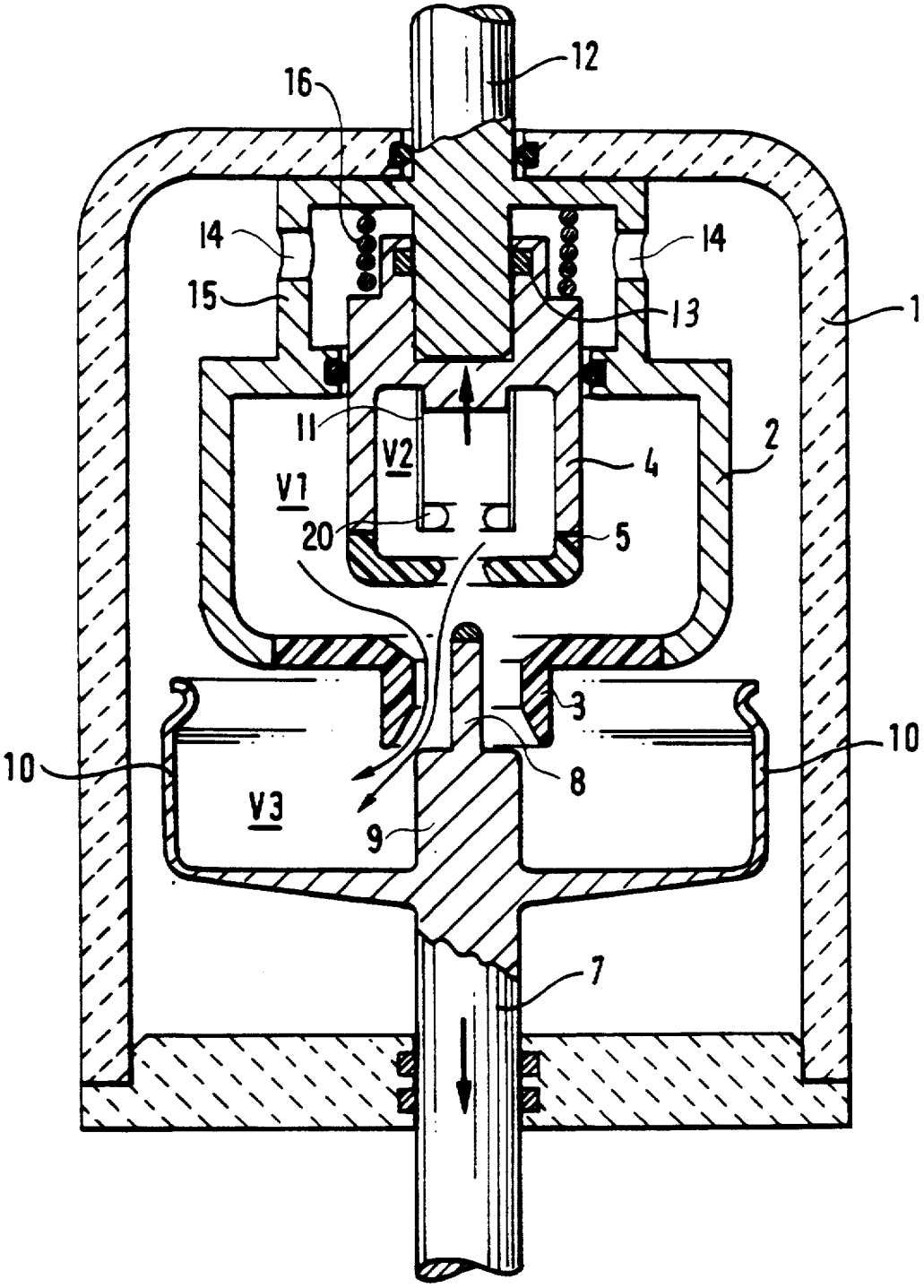
FIG. 4 represents the circuit-breaker of FIG. 2, the moving arcing contact being in the position suitable for interrupting high currents.

In order to interrupt low currents as shown in FIG. 3, the small cylinder 4 remains in place and gas flow, as indicated by an arrow, takes place directly from the volume V2 into the expansion volume V3 in which the gas pressure is lower than that in volume V2, this improving the efficiency with which the electric arc is extinguished. For high currents, the rise in pressure of the gas in the volumes V1 and V2 causes the small cylinder 4 to slide within the large cylinder 2 and the third cylinder 15, along the same axis as that on which the moving contact 7 slides and in the opposite direction (as shown in FIG. 4), until the small cylinder 4 abuts the stationary portion 12 of the arcing contact 6. Displacement of the small cylinder 4 is caused by the rise in gas pressure due to the electric arc in volume V2. The displacement of the small cylinder 4 causes the nozzles 3 and 5 to separate. The two arrows indicate the flow of gas which takes place from the two volumes V1 and V2 into the volume V3 as in the preceding case. After the current has been interrupted, the small cylinder 4 is returned to its rest position under the influence of the spring 16. This assembly allows the stroke of the moving arcing contact 7 to be reduced.

Figure 5:
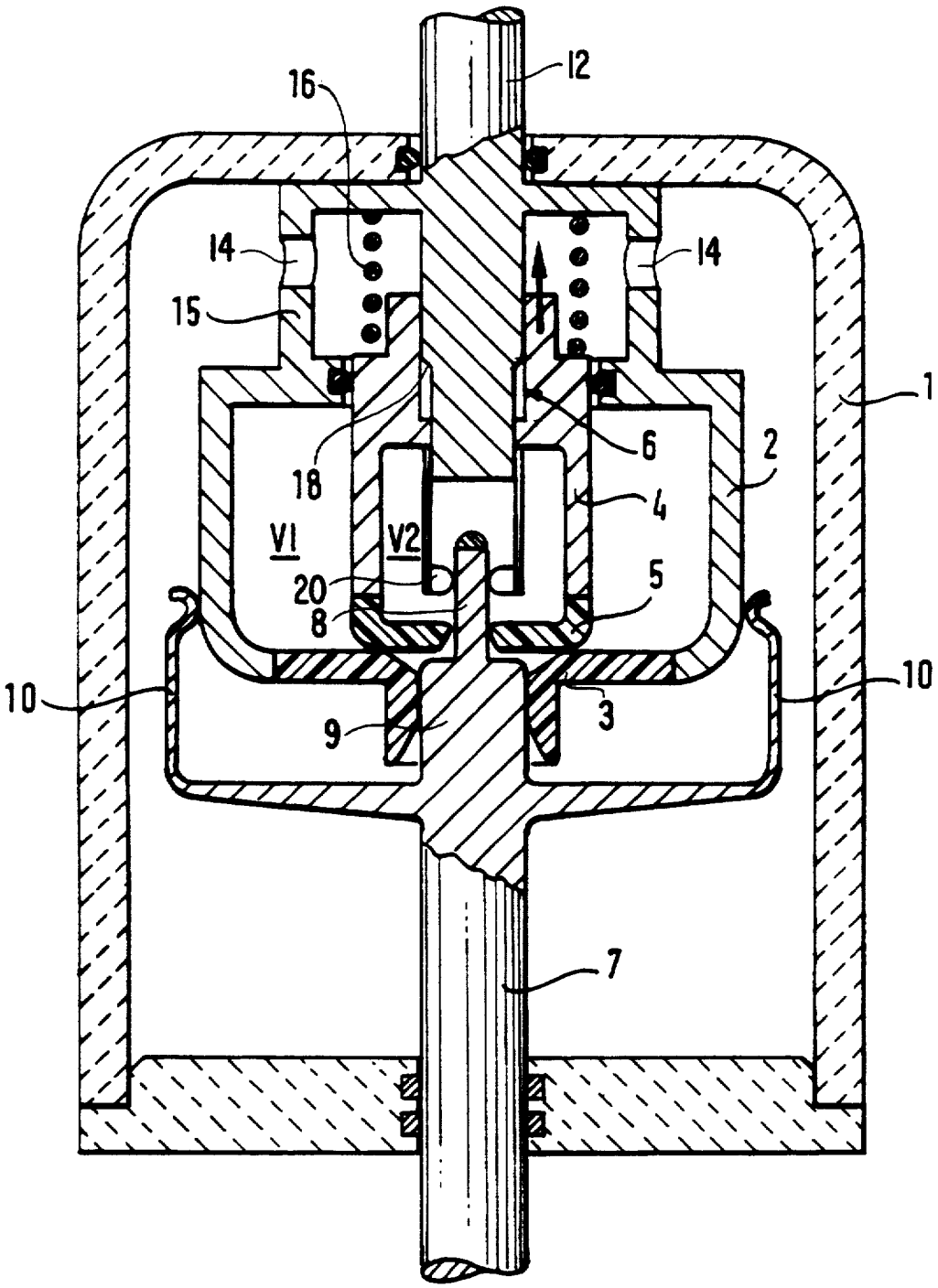
FIG. 5 represents another variant of the circuit-breaker according to the invention.

In yet another variant, as shown in FIG. 5, the first contact 6 is just one stationary part and the small cylinder 4 slides within the large cylinder 2 and along the stationary first contact 6. The first contact 6 has a shoulder 18 which forms an abutment to limit the stroke of the small cylinder 4.

The action of the spring 16 ensures that the nozzle 5 is always in contact with the nozzle 3. The electric arc produced by low currents to be interrupted is extinguished in identical fashion to that shown in FIG. 3. With high currents, the rise in pressure of the gas in volumes V1 and V2 causes the small cylinder 4 to slide inside the large cylinder 2 and the third cylinder 15, but the electric arc to be extinguished is not lengthened by the displacement of the small cylinder 4 because the arcing contact 6 remains stationary, thereby increasing the efficiency with which the electric arc is extinguished.

We claim:

1. A puffer circuit-breaker, comprising:
   - a casing (1) filled with an electric arc extinguishing fluid;
   - a first closure member (2) disposed inside said casing and defining a first thermal expansion chamber;
   - a second closure member (4) disposed within said first closure member and defining a second thermal expansion chamber;
   - a first arcing contact (7) slidably mounted within said casing so as to slide axially with respect to said casing and extending into said first and second thermal expansion chambers; and
   - a second arcing contact (6) stationarily mounted within said casing and extending axially into said second thermal expansion chamber and operative to cooperate electrically with said first arcing contact,
   - wherein said second closure member comprises an inner peripheral portion which is slidably mounted on said second arcing contact, and an outer peripheral portion which is slidably mounted within said first closure member.

2. The circuit-breaker according to claim 1, in which the second arcing contact extends axially within the second thermal expansion chamber in the same direction as that in which the first arcing contact slides and in which the second closure member (4) moves in translation along said direction in which the first arcing contact slides.

3. The circuit-breaker according to claim 2, in which the first closure member (2) is provided with a first blast nozzle (3) superposed with a second blast nozzle (5) provided on the second closure member (4), said nozzles having substantially concentric cross-sections.

4. The circuit-breaker according to claim 3, in which the first blast nozzle (3) has a larger cross-section than that of the second blast nozzle (5).

5. The circuit-breaker according to claim 4, in which the first arcing contact (7) comprises a first portion (8) of cross-section complementary to that of the second blast nozzle (5) so as to close the second blast nozzle, and a second portion (9) of cross-section complementary to that of the first blast nozzle (3) so as to close the first blast nozzle.

6. The circuit-breaker according to claim 1, in which the second arcing contact has a shoulder (18) which is operative to contact the inner peripheral portion of the second closure member to limit the axial movement of the second closure member relative to the first closure member.

7. The circuit-breaker according to any preceding claim 1, in which said first and second closure members are cylinders of concentric cross-section.

* * * * *